US011299328B2

(12) United States Patent
Aboabdo

(10) Patent No.: US 11,299,328 B2
(45) **Date of Patent: *Apr. 12, 2022**

(54) BOTTLE AND CAP ARRANGEMENT

(71) Applicant: Chubby Gorilla, Inc., Fullerton, CA (US)

(72) Inventor: Ibrahiem H. Aboabdo, Yorba Linda, CA (US)

(73) Assignee: Chubby Gorilla, Inc., Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/938,681

(22) Filed: Jul. 24, 2020

(65) Prior Publication Data

US 2020/0369442 A1 Nov. 26, 2020

Related U.S. Application Data

(63) Continuation of application No. 16/370,640, filed on Mar. 29, 2019, now Pat. No. 10,723,526.

(51) Int. Cl.

| | |
|---|---|
| ***B65D 47/18*** | (2006.01) |
| ***B65D 47/12*** | (2006.01) |
| ***B65D 43/02*** | (2006.01) |

(52) U.S. Cl.

CPC ..... *B65D 47/18* (2013.01); *B65D 43/0231* (2013.01); *B65D 47/122* (2013.01); *B65D 2251/0018* (2013.01); *B65D 2251/0087* (2013.01); *B65D 2251/023* (2013.01)

(58) Field of Classification Search

CPC .. B65D 47/18; B65D 43/0231; B65D 47/122; B65D 2251/0018; B65D 2251/087; B65D 2251/023

USPC ..... 222/212, 420, 519, 545, 547, 564, 567, 222/570, 571

See application file for complete search history.

(56) References Cited

U.S. PATENT DOCUMENTS

| | | | |
|---|---|---|---|
| 2,736,447 | A | 2/1956 | De Brock |
| 2,854,163 | A | 9/1958 | Barnby |
| 3,266,682 | A | 8/1966 | Schultz |
| 4,076,152 | A | 2/1978 | Mumford |
| 4,334,638 | A | 6/1982 | Stock |
| 4,427,138 | A | 1/1984 | Heinlein |
| 4,498,609 | A | 2/1985 | Stock |
| 4,705,181 | A | 11/1987 | Burke et al. |
| 5,102,016 | A | 4/1992 | Ball et al. |
| 5,156,303 | A | 10/1992 | Yamamoto et al. |
| 5,263,615 | A | 11/1993 | Anderson et al. |
| 5,316,054 | A | 5/1994 | Hall et al. |
| 5,462,200 | A | 10/1995 | Weiler |
| 6,065,648 | A | 5/2000 | Tauber |
| 6,076,709 | A | 6/2000 | Wilner |
| 6,334,557 | B1 | 1/2002 | Yang |

(Continued)

*Primary Examiner* — Paul R Durand
*Assistant Examiner* — Michael J. Melaragno
(74) *Attorney, Agent, or Firm* — Knobbe, Martens, Olson & Bear, LLP

(57) ABSTRACT

A bottle assembly that includes a bottle with a finish having a mouth for containing an E-liquid. The mouth of the bottle is sealed with a plug having an anti-drip well. The anti-drip well sized to prevent inadvertent spillage of the E-liquid contained within the bottle. An annular cap protrusion of the plug can engage with a channel on an upper portion of the bottle to attach the plug with the upper portioned with the mouth of the bottle. A lower channel edge can include a notch that can be used as a wedge to incrementally remove the plug from the mouth of the bottle without damage thereto.

16 Claims, 13 Drawing Sheets

(56) References Cited

U.S. PATENT DOCUMENTS

| | | | | |
|---|---|---|---|---|
| 6,632,202 | B1 | 10/2003 | Hagele | |
| 6,857,542 | B1 | 2/2005 | Mettler et al. | |
| 7,051,906 | B2 | 5/2006 | Kis et al. | |
| 7,063,241 | B2 | 6/2006 | Spada et al. | |
| 7,175,057 | B2 | 2/2007 | Mutterle | |
| 7,178,703 | B2 | 2/2007 | Spada et al. | |
| 7,213,727 | B2 | 5/2007 | Kokubo | |
| 7,537,141 | B1 | 5/2009 | Robinson | |
| 7,677,417 | B2 | 3/2010 | Leiner et al. | |
| 7,758,553 | B2 | 7/2010 | Poisson et al. | |
| 8,056,766 | B2 | 11/2011 | Grevin | |
| 8,444,610 | B2 | 5/2013 | Grevin | |
| D832,718 | S | 11/2018 | Aboabdo | |
| D834,950 | S | 12/2018 | Aboabdo | |
| D855,476 | S | 8/2019 | Aboabdo | |
| D860,004 | S | 9/2019 | Aboabdo | |
| 10,723,526 | B1 * | 7/2020 | Aboabdo | B65D 47/06 |
| 2003/0080146 | A1 | 5/2003 | Moros et al. | |
| 2004/0050881 | A1 | 3/2004 | Deussen | |
| 2004/0140319 | A1 | 7/2004 | Gerondale | |
| 2005/0040182 | A1 | 2/2005 | Suzuki | |
| 2005/0274744 | A1 | 12/2005 | Spada et al. | |
| 2006/0032873 | A1 | 2/2006 | Gerondale et al. | |
| 2006/0037972 | A1 | 2/2006 | Leiner et al. | |
| 2007/0233021 | A1 | 10/2007 | Poisson et al. | |
| 2008/0067194 | A1 | 3/2008 | Faurie | |
| 2009/0101681 | A1 | 4/2009 | Dato et al. | |
| 2010/0016814 | A1 | 1/2010 | Gokhale et al. | |
| 2010/0145287 | A1 | 6/2010 | Grevin | |
| 2010/0147899 | A1 | 6/2010 | Nardi | |
| 2011/0031277 | A1 | 2/2011 | Maas et al. | |
| 2011/0297703 | A1 | 12/2011 | Wilson et al. | |

* cited by examiner

BOTTLE AND CAP ARRANGEMENT

INCORPORATION BY REFERENCE TO ANY PRIORITY APPLICATIONS

This application is a continuation U.S. patent application Ser. No. 16/370,640, filed Mar. 29, 2019, the entirety of which is hereby incorporated by reference.

BACKGROUND

Field

The present disclosure generally relates to dispensing bottles.

Related Art

Bottles having nozzles can be used to contain and dispense liquids in a precise manner. A nozzle of a bottle can be attached with a plug inserted into the mouth of the bottle. Manufacturing the plug and the bottle separately facilitates the distribution process for certain liquids, such as e-liquids used in vaping and e-cigarettes. The bottles and plugs can be shipped to a manufacturer in an unassembled state. The manufacturer can fill the bottles with the desired liquid and then attach the removable plug and/or other bottle components or labels to form a saleable unit.

SUMMARY

The systems, methods and devices described herein have innovative aspects, no single one of which is indispensable or solely responsible for their desirable attributes. Without limiting the scope of the claims, some of the advantageous features will now be summarized.

To prevent spillage of the liquid content from the bottle, the plug should fit tightly with the mouth of the bottle. Removing the plug can be difficult and the plug and/or bottle can easily become damaged by the use of force. This would render the bottle and the plug potentially unusable because one of the primary purposes of the bottle is to prevent the inadvertent spillage of liquids. Damage to the bottle significantly increases this potential. Nevertheless, it is also desirable to make the bottle reusable, which requires that the plug be removable from the mouth of the bottle to allow refilling. Thus, according to one aspect of the present invention, a notch comprising a chamfer is provided on a rim of the bottle that facilitates the removal of the plug from the mouth of the bottle. The notch facilitates incrementally separating the plug from the mouth of the bottle in a manner that safeguards the bottle and the plug against damage.

Another aspect of the present invention is the use of a bottle cap to remove the plug from the bottle. An edge or lip of the bottle cap can be inserted into a slot between the bottle and the plug by sliding on the chamfered surface of the notch. The bottle can then be rotated by a user with the lip of the bottle cap remaining within the slot between the plug and the bottle. As the bottle is rotated, the cap can incrementally separate the plug from the bottle until it is fully removed. The notch can include a depth that is equal to or greater than a thickness of the lip of the bottle cap.

Another aspect of the present invention is an anti-drip nozzle. The anti-drip nozzle can include a well for dispensing liquid from the bottle. The well can have a diameter. The diameter can be selected based on the viscosity and surface adhesion properties of the liquid. The diameter can be 1.2 mm. The anti-drip well can substantially prevent leakage of the liquid contained within the bottle through the nozzle. The plug can also include an orifice. The orifice can provide access through a top portion of the plug into the well. The orifice can have a diameter. The diameter can be selected based on the viscosity and surface adhesion properties of the liquid. The diameter can be 1.0 mm. The orifice can substantially isolate the anti-drip well from the liquid contained within the bottle to prevent dripping of the liquid through the nozzle. The nozzle can include the orifice and/or the anti-drip well.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein.

BRIEF DESCRIPTION

DETAILED DESCRIPTION

The various features and advantages of the systems, devices, and methods of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

Figure 1:
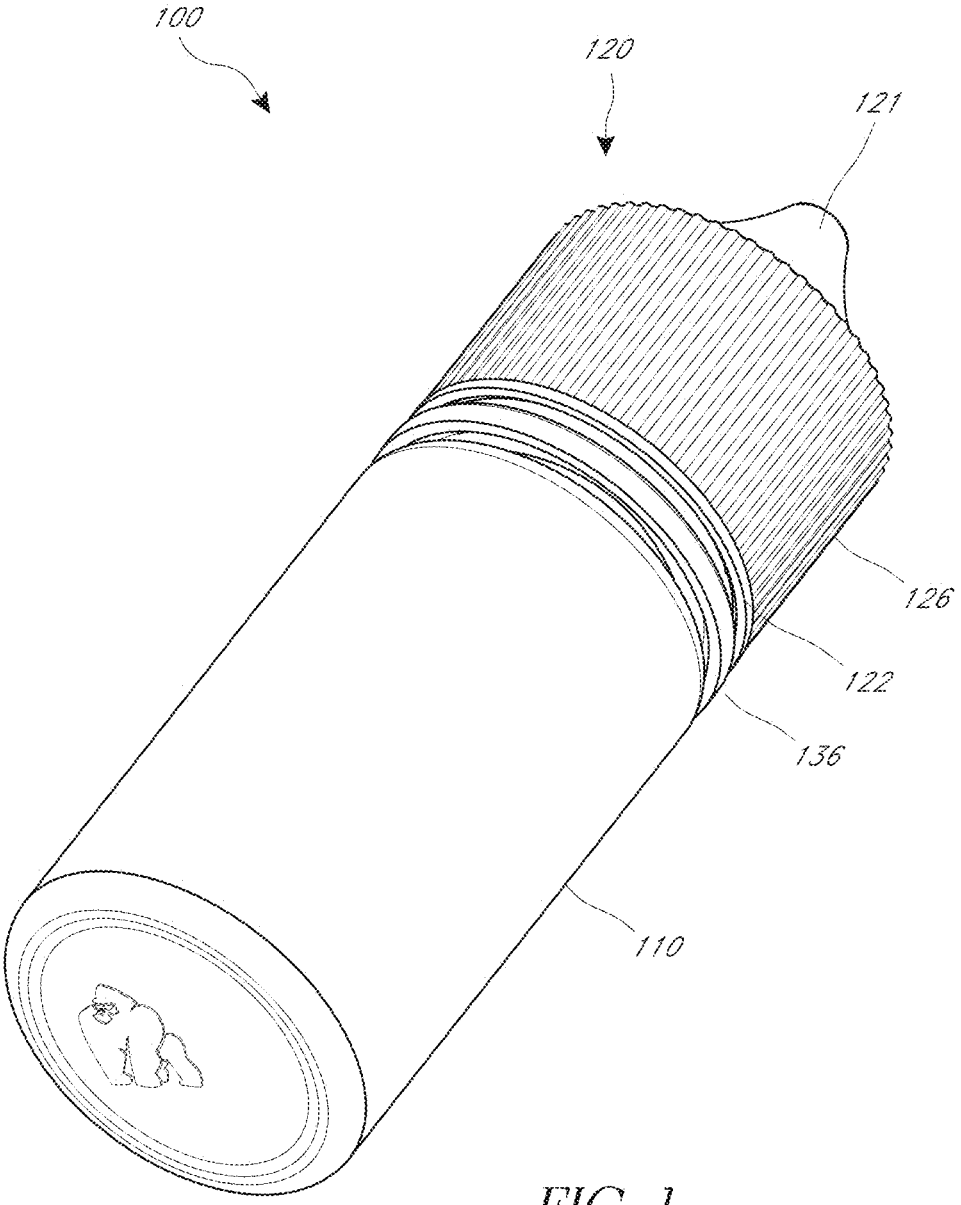
FIG. 1 is a perspective view of a bottle assembly.
Figure 4A:
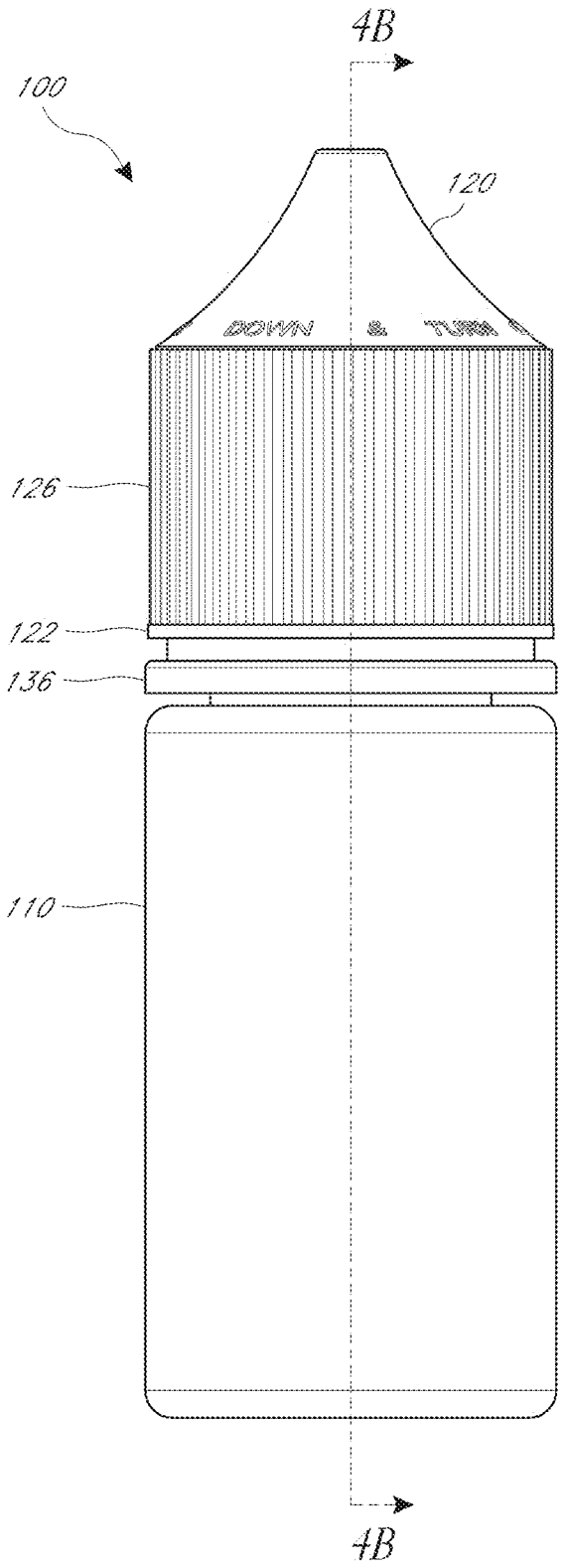
FIG. 4A is a side view of the bottle assembly of FIG. 1.
Figure 4B:
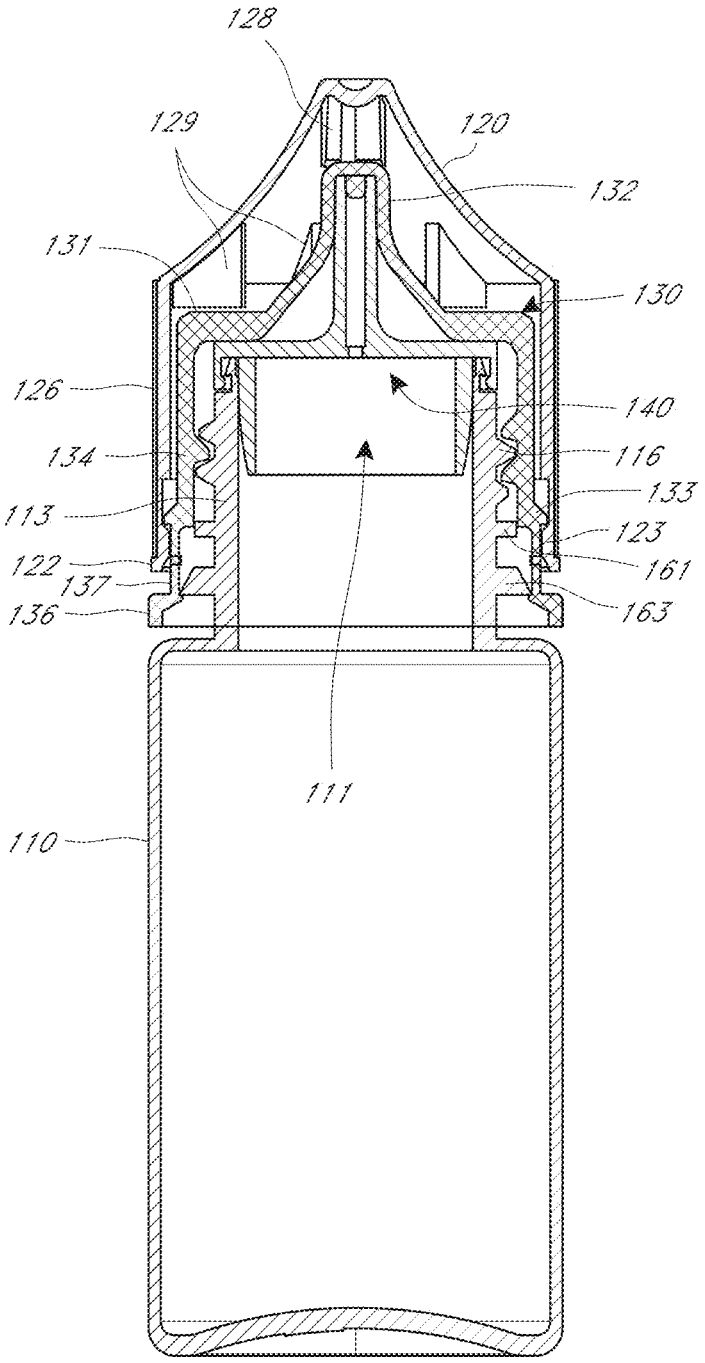
FIG. 4B is a section view taken along the line 4B-4B and FIG. 4A.
Figure 5:
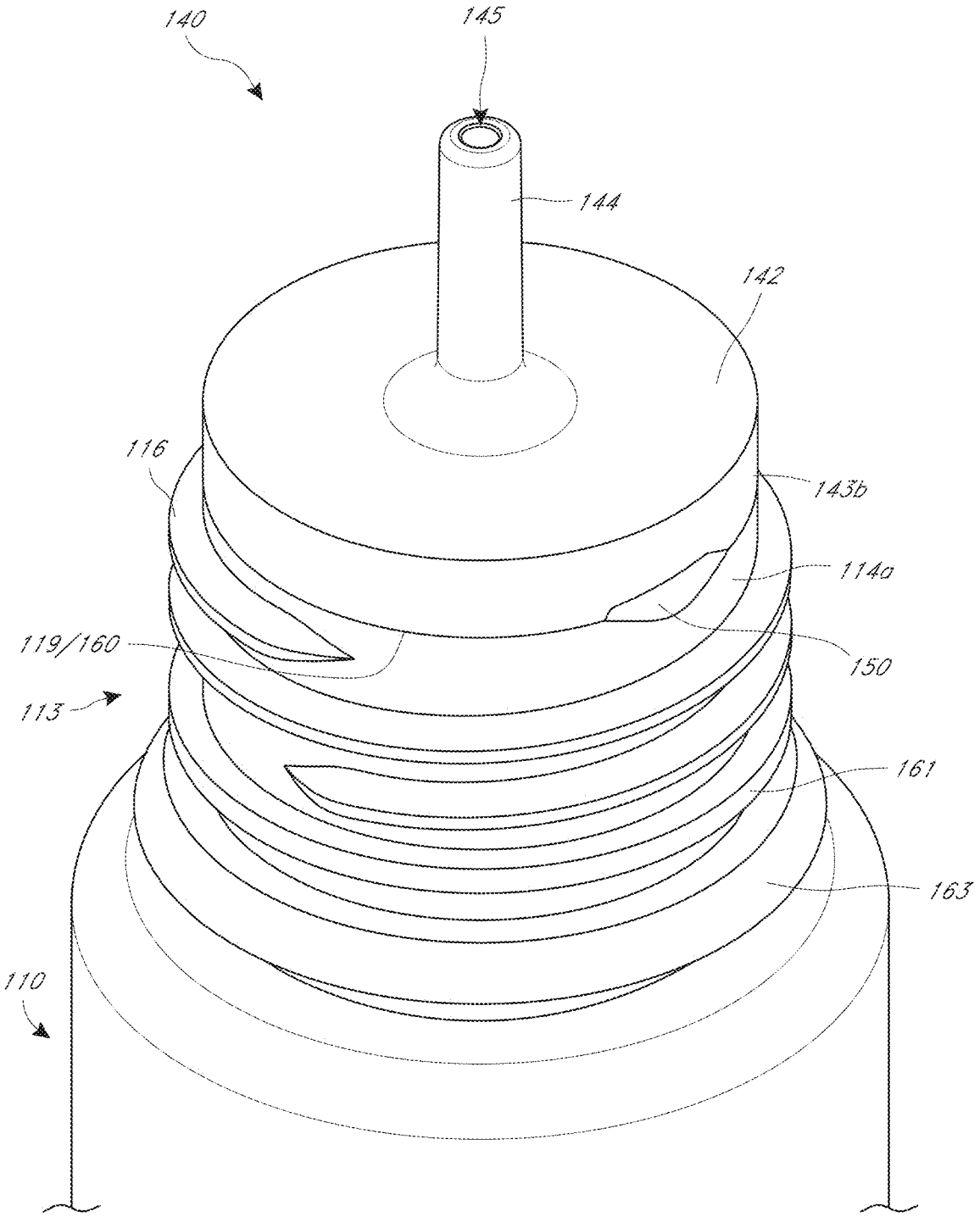
FIG. 5 is a perspective view of the partial bottle assembly of FIG. 3A.
Figure 6:
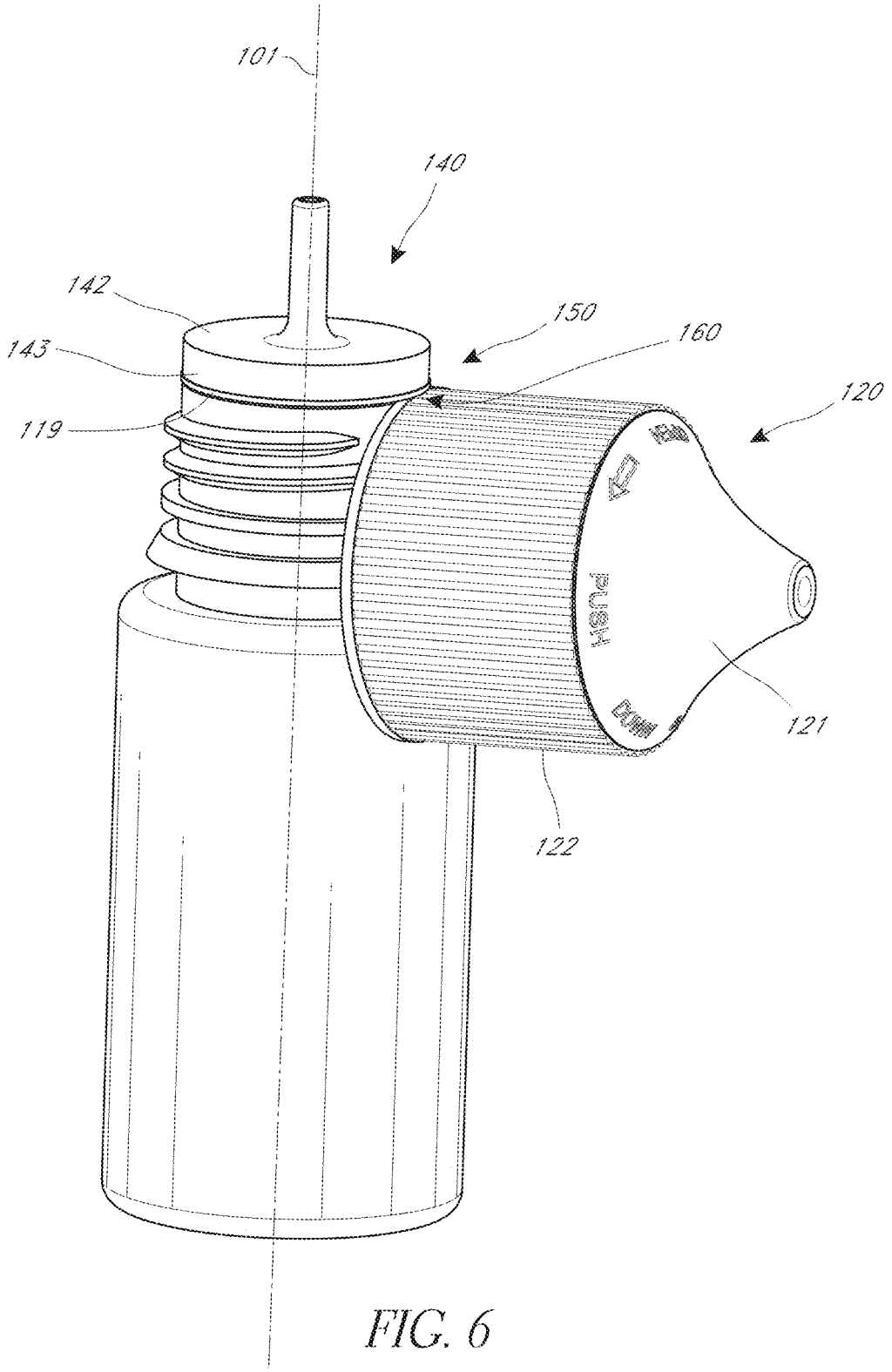
FIG. 6 is a perspective view of an outer cap of the bottle assembly of FIG. 1 inserted into a notch of the bottle to facilitate removal of the plug from a mouth of the bottle.
Figure 7:
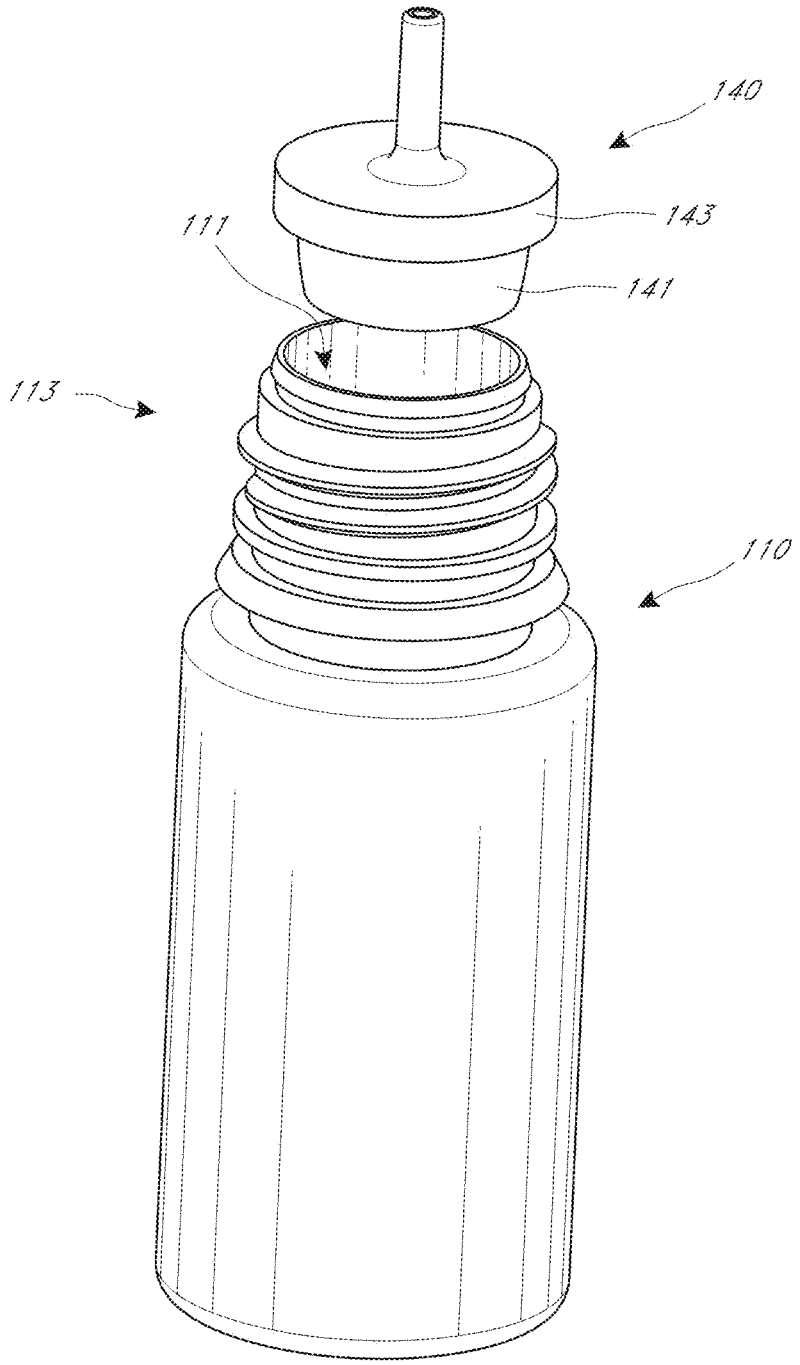
FIG. 7 shows the plug fully removed from the bottle shown in FIG. 6.

FIGS. 1 and 4A-B illustrate a bottle assembly 100. The bottle assembly 100 can be a container for storing a liquid. An exemplary liquid is an e-liquid used for e-cigarettes and vaping. An e-liquid can be composed of propylene glycol, vegetable glycerol, liquid nicotine, and/or various flavorant compounds. The bottle assembly 100 can provide drip free storage of the liquid contained therein. The bottle assembly 100 can also provide precise, spill-free dispensing of the liquid contained therein. In some example, dispensing the liquid from the bottle assembly 100 can be accomplished by applying a pressure to sides of the bottle assembly 100 and forcing the liquid out through a nozzle.

One challenge in the design of the bottle assembly 100 is to securely store the liquid within the container in a drip free manner and also allow the liquid to be easily dispensed therefrom at the appropriate time. The drip free capabilities of the bottle assembly 100 are particularly important where the liquid contained within the container has undesirable properties. E-liquids, for example, can stain, have strong smell, and/or can be a mild irritant. The dispensing function of the bottle assembly 100 can facilitate dispensing of the e-liquid into small containers such as reservoirs of vaporizers or e-cigarettes. Desirably, the bottle assembly 100 facilitates drip free dispensing into said vaporizers or e-cigarettes. Desirably, the bottle assembly 100 also prevents spillage of the e-liquid even if a cap of the bottle is inadvertently removed from the bottle assembly.

The bottle assembly 100 can include any of a bottle 110, outer cap 120, inner cap 130, and plug 140. The bottle assembly 100 can have a generally cylindrical outer profile. The bottle assembly, however, is not limited to the cylindrical outer profile and can take any shape or form factor. The bottle assembly 100 and/or any of the subcomponents thereof can be formed of a plastic or other material type. An exemplary material is polyethylene terephthalate.

Bottle

Figure 2A:
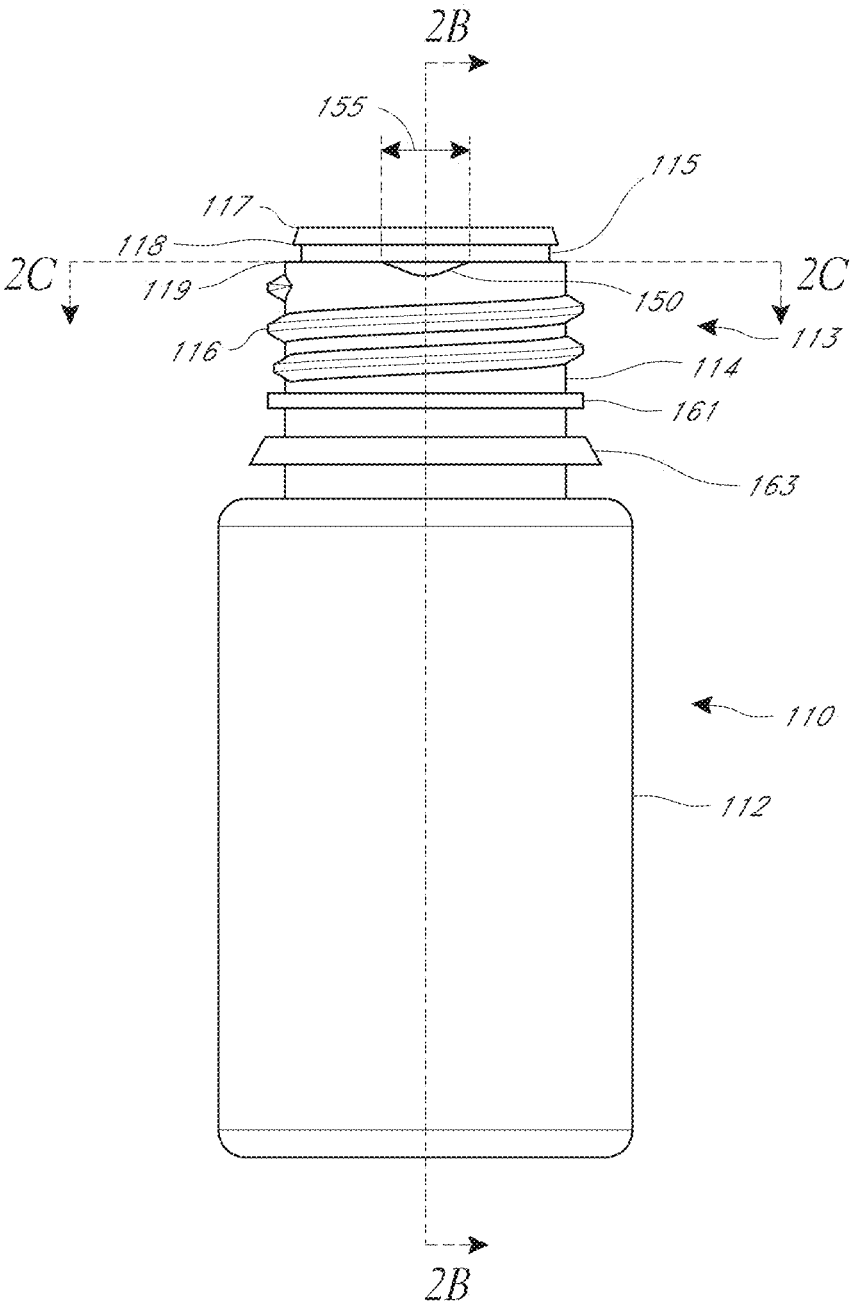
FIG. 2A is a side view of a bottle of the bottle assembly of FIG. 1.
Figure 2B:
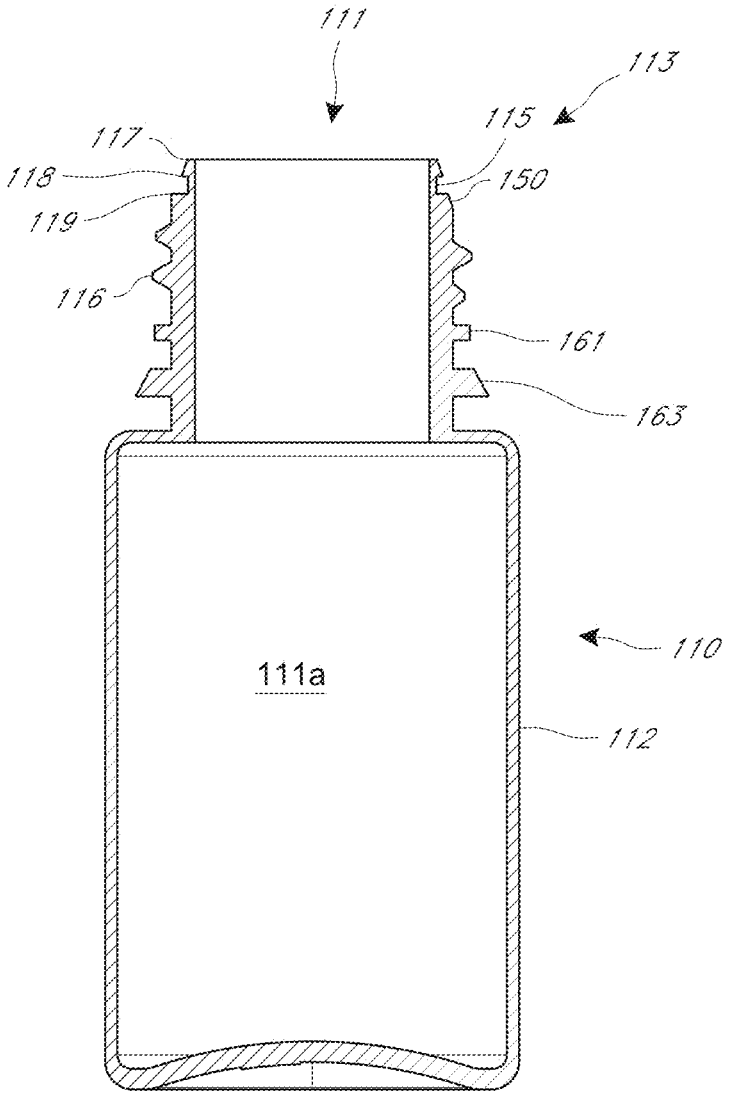
FIG. 2B is a section view taken along the line 2B-2B in FIG. 2A.

The bottle assembly 100 can include the bottle 110. FIGS. 2A-2B illustrate the bottle 110. The bottle 110 can be sized to accommodate various volumes of liquid therein. Exemplary volumes for the bottle 110 are 10-200 mL. The bottle 110 can be formed into shape through a blow molding, injection molding and/or other manufacturing process. The bottle 110 can be manufactured through a two step process. A preform bottle can be injection molded and afterwards expanded into the bottle shape through a balloon molding process. In some example, the bottle 110 can be formed in a generally cylindrical shape.

The bottle 110 can include a mouth 111. The mouth 111 can provide an opening into an interior volume 111*a* of the bottle 110. The mouth 111 can have a circular shape or other shape profile. The size of the mouth 111 can be selected in accordance with the total volume of the liquid capacity of the bottle 110. The bottle 110 can be formed of an integral material.

The bottle 110 can include a finish 113. The finish 113 can be a stem portion of the bottle 110. The mouth 111 can be located on the finish 113. The opening of the mouth 111 can be defined by an interior cylindrical wall of the finish 113. The finish 113 can include one or more threads 116. The threads 116 can extend around a circumference of the finish 113. The threads 116 can provide a connection with a cap assembly of the bottle assembly 100, as described further below. In some implementations, the bottle 110 includes two threads 116.

The bottle 110 can include a bottle body 112. The bottle body 112 can comprise a majority of the interior volume 111*a* of the bottle 110. The bottle body 112 can be generally cylindrical in shape, however, any shape or profile is fully contemplated herein. The finish 113 can extend upwardly from the bottle body 112. The bottle body 112 can include outer circumferential walls and/or a flat bottom portion.

The finish can include a finish body 114. The finish body 114 can be a cylindrical portion of the finish extending upwardly from the bottle body 112. The threads 116 can be a molded portion of the finish body 114. The finish body 114 can include a top surface 117. The top surface 117 can extend around a circumference of the finish body 114. The top surface 117 can extend around the mouth 111 of the bottle 110. In some examples, the top surface 117 is planar. In some examples, the top surface 117 can include one or more annular grooves.

The finish body 114 can include a plug channel 115. The plug channel 115 can be located below and adjacent to the top surface 117. The plug channel 115 can be a channel within the finish body 114 having a reduced diameter in comparison with one or more adjacent portions of the finish body 114. In some examples, the radially innermost surface of the plug channel 115 is flat, curved, grooved or other profile.

The finish body 114 can include a channel lip 118. The channel lip 118 can be located between the plug channel 115 and the top surface 117. The channel lip 118 can define an upper boundary of the plug channel 115. The channel lip 118 can have a reduced diameter in comparison with lower portions of the finish body 114. The diameter of the channel lip 118 can be greater than the diameter of the innermost surface of the plug channel 115. An outer circumferential surface of the channel lip 118 can be tapered outwardly from the top surface 117 towards the plug channel 115.

The finish body 114 can include a lower channel edge 119. The lower channel edge 119 can be located below and adjacent to the plug channel 115. The lower channel edge 119 can define a lower boundary of the plug channel 115. The upper and lower boundaries of the plug channel 115 can comprise planar surfaces. The planar surfaces can be parallel or angled. The planar surfaces can be orthogonal with an outer circumferential surface 114*a* of the finish body 114.

The lower channel edge 119 can include a notch 150. The notch 150 can be an outwardly curved (from the plug channel 115 downwards) or chamfered portion of the lower channel edge 119. The notch 150 can be located within the finish body 114. The notch 150 can be located on or across a portion of the lower channel edge 119. The notch 150 can be located adjacent to an upper end 116*a* of one of the threads 116.

The bottle 110 can include multiple notches 150. The notches 150 can be spaced at regular intervals (e.g., 60°, 90°, 120°, 180°) around the lower channel edge 119. The multiple notches 150 can each be located between upper ends 116*a* of each the threads 116 in embodiments including multiple threads. The bottle 150 can include two notches 150. The two notches 150 can be spaced apart 180° on the lower channel edge 119. Each of the two notches 150 can be located adjacent to a respective upper end 116*a* of two threads 116.

Figure 2C:
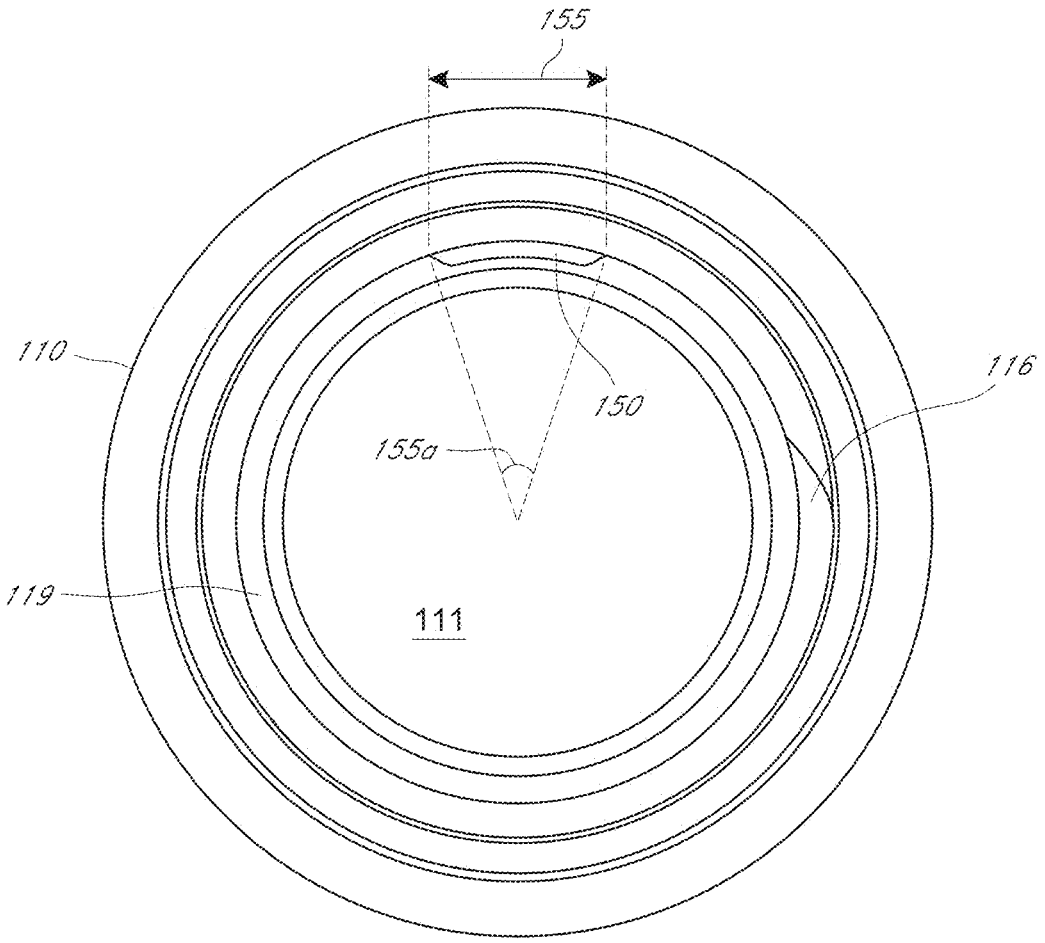
FIG. 2C is a section view taken along the line 2C-2C in FIG. 2A.

The notch 150 can have a notch width 155. The notch width 155 can be a linear distance across the notch 150. The notch width 155 can be determined based on the size of the bottle 110. The notch width can be 3.0 mm. The notch width 155 can be within a tolerance of +/−1.0 mm. An exemplary range of notch widths can be between 2 mm and 10 mm. The notch 150 can also be defined in terms of an angle 154. The angle 154 for the notch 150 can be 30°+/−15°, as shown in FIG. 2C. A depth of the notch 150 into the finish body 114 can vary across the notch width 155 from end to end. The depth can be greatest in a center of the notch 150 and narrow towards outer ends thereof. The lower channel edge 119 can include one, two or more notches. The notch 150 can have a height 150*a* 1.8 mm. The height 150*a* can have a tolerance of +/−0.14 mm. The height 150*a* can be from 1.0 mm to 3.0 mm, in some implementations.

The finish body 114 can include a cap seat 161. The cap seat 161 can be located below the threads 116. The cap seat 161 can include a diameter greater than the diameter of the finish body 114. The cap seat 161 can form an annular ridge extending outwardly from the finish body 114.

The finish body 114 can include a collar 163. The collar 163 can be located below the cap seat 161. The collar 163 can include a diameter greater than the diameter of the finish body 114. The collar 163 can form an annular ridge extending outwardly from the finish body 114. The collar 163 can be tapered outwardly in the direction from the top surface 117 towards the bottle body 112. The collar 163 can be located between the cap seat 161 and the bottle body 112.

Plug and Bottle Assembly

Figure 3A:
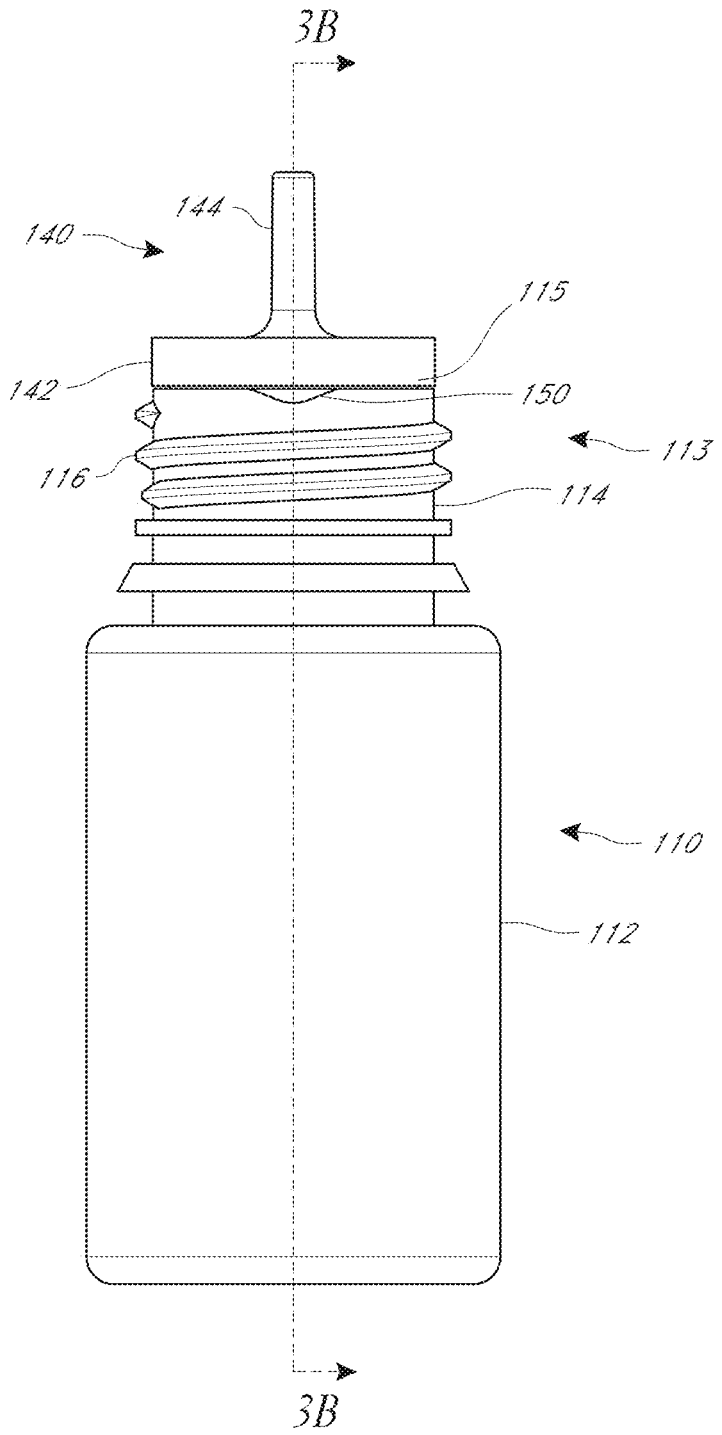
FIG. 3A is a partially assembled view of the bottle assembly of FIG. 1 including the bottle and a plug.
Figure 3B:
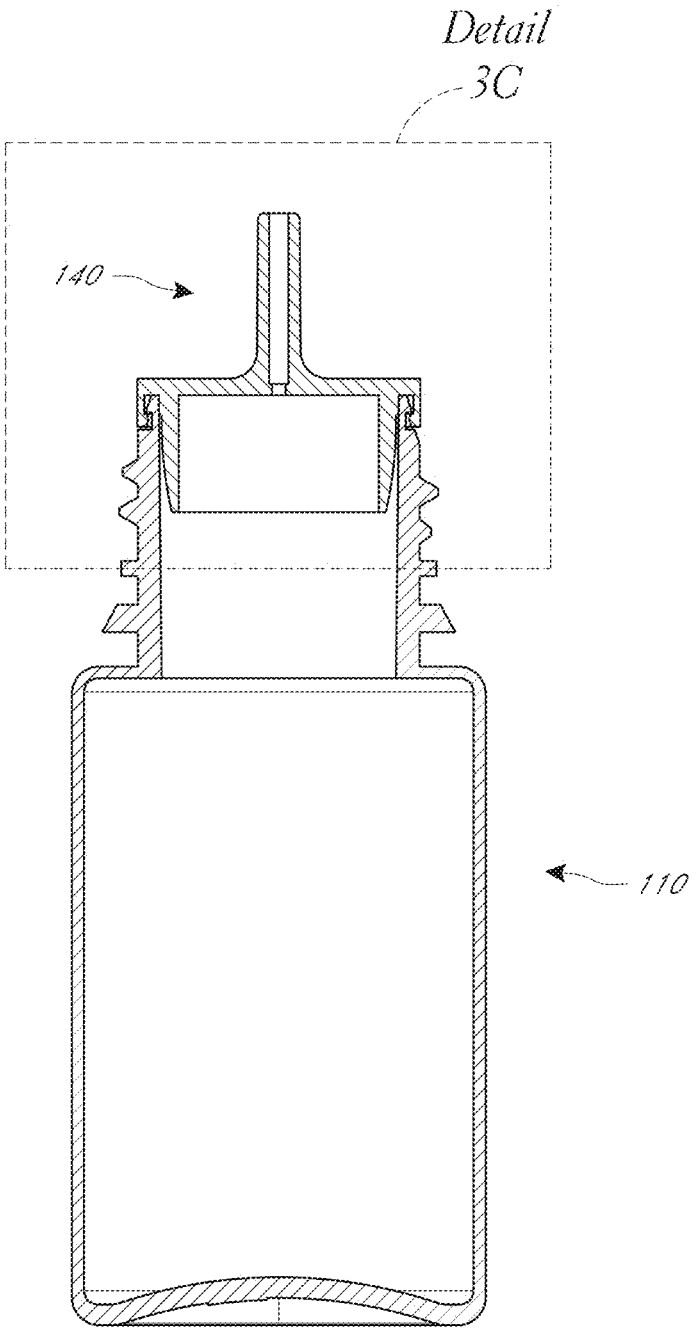
FIG. 3B is a section view taken along the line 3B-3B in FIG. 3A.
Figure 3C:
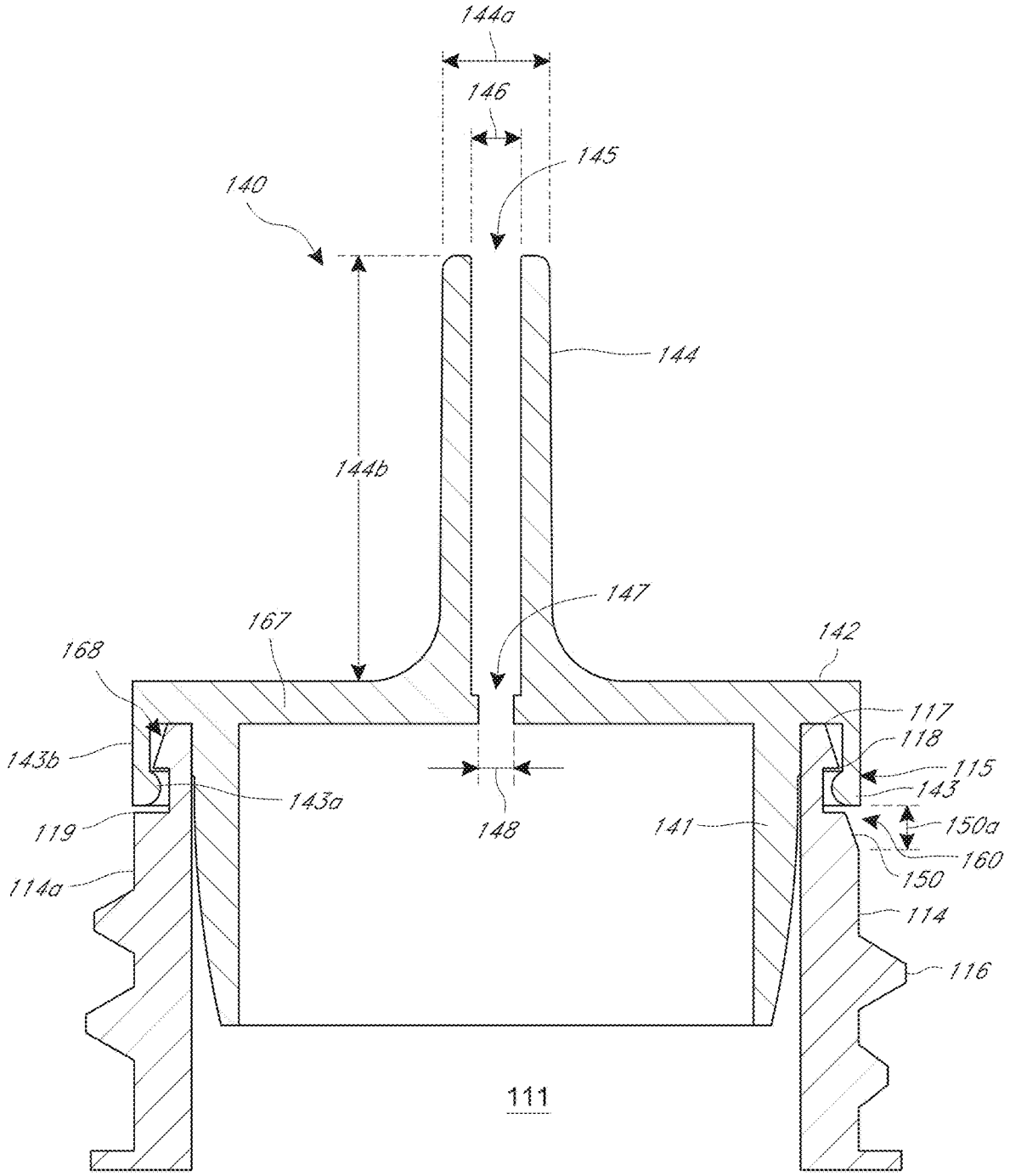
FIG. 3C is a detail of FIG. 3B.

The bottle assembly 100 can include the plug 140. FIGS. 3A-3C illustrate the plug 140 assembled with the bottle 110. The plug 140 can include a nozzle 144. The nozzle 144 can extend transversely from a cap portion 142 of the plug 140. The nozzle 144 can extend from a proximal portion to a distal tip. The nozzle 144 can have a cylindrical or other cross-sectional shape. The cross-sectional shape of the nozzle 144 can be uniform from the proximal portion through the distal tip. The nozzle 144 can have a diameter 144*a*. The diameter 144*a* can be 3.0 mm. The diameter 144*a* can be within a tolerance of +/−0.14 mm. In some implementations, the diameter 144*a* is between 2.5 mm and 6 mm. The nozzle 144 can have a length 144*b*. The length 144*b* can be 12 mm. The length 144*b* can have a tolerance of +/−0.14 mm. In some implementations, the length 144*b* is between 10 and 14 mm. In one implementation, the length is up to 20 mm. In some implementations, the diameter 144*a* is included in the nozzle 144 but not the specified lengths 144*b*. In some implementations, the length 144*b* is included in the nozzle 144 but not the specified diameter 144*a*.

The nozzle 144 can include an anti-drip well 145. The anti-drip well 145 can provide communication for the liquid through the plug 140. The anti-drip well 145 can extend through the material of the nozzle 144. The anti-drip well 145 can extend from an uppermost portion of the plug 140 through the cap portion 142. The anti-drip well 145 can provide a dispensing route for liquid contained within the bottle 110. When the bottle 110 is squeezed, the liquid can pass through the anti-drip well 145.

The anti-drip well 146 can have a cylindrical or other cross sectional shape. The anti-drip well 145 can have a well diameter 146. The well diameter 146 can be uniform throughout the nozzle 144. The well diameter 146 can be only at a distal tip of the nozzle 144. The well diameter 146 can be 1.2 mm. The well diameter can have an acceptable tolerance of +/−0.14 mm. The well diameter 146 can be selected based on one or more properties of the liquid contained within the bottle 110. The properties of the liquid can include viscosity and/or the surface adhesion properties of the molecules of the liquid with the material of the nozzle 144. A narrow well diameter 146 can inhibit leakage through the anti-drip well 145. The well diameter 146 at 1.2 mm can substantially prevent leakage of e-liquids through dripping from the nozzle 144.

The cap portion 142 can include an orifice 147. The orifice 147 can be aligned with the anti-drip well 145. The orifice 147 can extend through the cap portion 142. The orifice 147 can be a cylindrical negative shape through the cap portion 142. The orifice 147 can have an orifice diameter 148. The orifice diameter 148 can be used to inhibit leakage of the liquid through the nozzle 144. The orifice diameter 148 can selected be based on one or more properties of the liquid contained within the bottle 110. The properties of the liquid can include viscosity and/or the surface adhesion properties of the molecules of the liquid with the material of the plug 140. The orifice diameter 148 can be 1.0 mm. The orifice diameter can be within a tolerance of +/−0.13 mm. The orifice diameter can be from 0.5 mm to 1.5 mm, in some implementations. Desirably, but not required, the orifice diameter 148 can be narrower than the well diameter 146. In alternative embodiments, the orifice diameter 148 can be greater than or equal to the well diameter 146. The orifice 147 can substantially isolate the anti-drip well 146 from the liquid contained within the bottle 110 to prevent dripping of the liquid through the nozzle 144. The nozzle 144 can include the orifice 147 and/or the anti-drip well 145.

The cap portion 142 can include a plug portion 141. The plug portion 141 can be a circumferential extension of a cap top 167 of the cap portion 142. The plug portion 141 can extend distally from the cap top 167. The plug portion 141 can be tapered inwardly from the cap top 167 to a distal end of the plug portion 141. The plug portion 141 can be sized to fit tightly within the mouth 111 of the bottle 110. The plug portion 141 can thereby seal with the mouth 111 by mechanical engagement with the inner circumferential walls of the finish 113.

The cap portion 142 can include annular cap protrusion 143. The annular cap protrusion 143 can form a cap groove 168. The cap groove 168 can be formed between the annular cap protrusion 143 and the plug portion 141. An upper most portion of the finish body 114 including the top surface 121 can engage within the cap groove 168. The top surface 121 can sealingly engage with the cap top 167 within the cap groove 168. Engagement between the cap portion 142 and the uppermost portion of the finish 114 can seal the mouth 111 of the bottle 110 against leakage.

The annular cap protrusion 143 can include an end portion 143*a*. The end portion 143*a* can include an inwardly protruding flange. The inwardly protruding flange can be rounded, pointed, squared, or other shape profile. The end portion 143*a* can be aligned with the plug channel 115. The inwardly protruding flange can be received within the plug channel 115. The plug 140 can be held in place on the finish 113, at least in part, by engagement of the end portion 143*a* within the plug channel 115. The channel lip 118 can engage with the inwardly protruding flange of the end portion 143*a* of the annular cap protrusion 143. The engagement of the channel lip 118 with the inwardly protruding flange can make it difficult to remove the plug 140 from the finish 113.

The annular cap portion 143 can include an outer circumferential surface 143*b*. The outer circumferential surface 143*b* can substantially align with the outer circumferential surface 114*a* of the finish body 114. An annular slot 160 can be formed between the lower member 143*a* and the lower channel edge 119 and/or the notch 150. The notch 150 provides a widened portion of the annular slot 160. The notch 150 can therefore be used to facilitate safe removal of the plug 140 from the finish body 114, as described further below.

The plug 140 can provide a tight seal with the finish 113. The engagement between the annular cap protrusion 143 and the channel 115 can be tighter than that illustrated in FIG. 4B. Desirably, little to no notch is left between the end portion 143*a* and the lower channel edge 119. However, the tightness of the fit between the upper portion of the finish 113 with the cap groove 168 and/or the tightness of the fit of the plug portion 141 within the mouth 111 can make it difficult to remove the plug 140. Accordingly, it can be difficult to remove the plug 140 from a mouth 111 without damage to the material of the plug 140 or finish 113.

Some damage to the plug 140 and/or the finish 113 can render the bottle assembly 100 useless for its intended purpose. Such damage can allow the plug 140 to be too easily removable from the mouth 111. This can lead to inadvertent spillage of the liquid contained within the bottle assembly 100. Furthermore, nicks and distortion of the material of the finish 113 and/or the plug 140 (e.g., from the use of tools to remove the plug 140) can allow leakage. Nevertheless, it is desirable that the bottle assembly 100 be reused after dispensing all of the liquid content contained within the bottle 110. It is also common for consumers to reuse the bottle assembly 100 by removing the plug 140 and refilling the bottle 110, despite these risks. Accordingly, the bottle assembly 100 can be improved by the structure of the notch 150.

Cap Assembly

The bottle assembly 100 can include the outer cap 120 and/or an inner cap 130 to form a cap assembly. FIGS. 4A-4B illustrate the bottle assembly 100 in an assembled configuration including the bottle 110, the outer cap 120, the inner cap 130 and the plug 140. The outer cap 120 can include a grip portion 126. The grip portion 126 can include one or more grip features. The grip features can include grooves, pebbled regions or other friction-enhancing features. The outer cap 120 can include a bottom lip 122. The bottom lip 122 can be a lowermost edge of the outer cap 120. The bottom lip 122 can extend around a circumference of the outer cap 120. The outer cap can include a conical portion 121. The conical portion 121 can form an upper surface of the outer cap 120. An inner circumferential surface of the outer cap 120 can include an annular retention lip 123 extending inwardly therefrom.

The conical portion 121 of the outer cap 120 can include a spring clip 128. The spring clip 128 can comprise a plurality of flanges extending downwardly and/or outwardly from the conical portion 121. The flanges can generally form a circular recessed area. The flanges of the spring clip 128 can be cantilevered from the conical portion 121.

The outer cap 120 can include a plurality of engagement members 129. The engagement members 129 can extend downwardly from the conical portion 121 of the outer cap 120. The engagement members 129 can be spaced at locations around a circumference of the outer cap 120. In one implementation, the engagement members 129 have a lowermost surface that is generally planer. The engagement members 129 can be used in conjunction with a child safety lock feature of the bottle assembly 100, as describe further below.

The bottle assembly 100 can include the inner cap 130. The inner cap 130 can include a threaded region 134. The threaded region 134 can include one or more threads for engagement with the threads 116 of the finish 113. An outer circumferential surface of the inner cap 130 can include an annular retention lip 133 extending outwardly therefrom. The annular retention lip 133 can engage with the annular retention lip 123 to rotatably couple the outer cap 120 with the inner cap 130. The inner cap 130 can be coupled within the outer cap 120. The inner cap 130 can be assembled by placement within the outer cap 120. The annular retention lip 133 can be placed above the annular retention lip 123.

The inner cap 130 can include a safety seal 136. The safety seal 136 can indicate tampering of the bottle assembly 100. The safety seal 136 can be a lower annular ring attached with the inner cap 130. The safety seal 136 can be attached by a frangible portion 137. The frangible portion 137 can be a thinned region of the material of the inner cap 130. The safety seal 136 can include a plurality of inwardly extending engagement fingers. The inwardly extending engagement fingers can engage with the finish 113. The outward taper of the collar 163 of the bottle 110 can provide a one-way engagement between the safety seal 136 and the collar 163.

The inner cap 130 can include a conical protrusion 132. The conical protrusion 132 can extend upwardly from a top portion 131 of the inner cap 130. The conical protrusion 132 can be centered on the inner cap 130. The conical protrusion 132 can be sized to fit within and/or engage with the spring clip 128. The flanges of the spring clip 128 can bias the inner cap 130 away from the conical portion 121 of the outer cap 120.

The inner cap 130 at the top portion 131 can include one or more slots 139. The slots 139 can correspond to the engagement members 129 of the outer cap 120. The slots 139 can be sized such that the engagement members 129 can fit within the one or more of the slots 139. Nevertheless, the engagement members 129 can be biased away from engagement with the slots 139 by the interaction of the spring clip 128 and the conical protrusion 132. Engagement of the engagement members 129 with the slots 139 can transfer a torque between the outer cap 120 and the inner cap 130 for removing and/or attaching the cap assembly with the finish 113.

The cap assembly can be attached with the bottle 110. The cap assembly can be aligned with the mouth 111 of the bottle 110. The cap assembly can be placed over the finish 113. The threaded region 134 of the inner cap 130 can engage with the threads 116 of the finish 113. A torque from the outer cap 120 to the inner cap 130 can rotate the cap assembly over the finish 113. The rotation can seat the inner cap 130 against the cap seat 161. The rotation can force the safety seal 136 over the collar 163.

The inner cap 130 and the outer cap 120 can form a child safety lock for the bottle assembly 100. The child safety lock operates to prevent opening of the bottle assembly 100 by children. The child safety lock can prevent transmitting torque between the inner cap 130 and the outer cap 120 without an additional orthogonal or downward force. The engagement members 129 of the outer cap 120 can be aligned with one or more of the corresponding slots 139 of the inner cap. The additional orthogonal force can overcome the bias of the spring clip 128 engaging with the conical protrusion 132. With the bias overcome, the one or more engagement members 129 can engage within the one or more of the slots 139. The engagement members 129 engaged within the one or more of the slots 139 can transmit the torque for attaching or removing the cap assembly with the bottle 110.

In the assembly position, the safety seal 136 can engage with and/or be located below the collar 163. The inner fingers of the safety seal can engage with the collar 163. The outward taper of the collar 163 and/or the inner fingers engaged with the collar 163 can prevent removal of the safety seal therefrom. After the safety seal 136 is initially seated, when the inner cap 130 is removed from the finish 113, safety seal 136 is prevented from being removed by the collar 163. With sufficient force, the frangible portion 137 of the inner cap 130 can separate from the safety seal 136 to allow removal of the cap assembly. The separated safety seal 136 can indicate possible tampering of the bottle assembly 100.

Plug Removal

FIGS. 5-8 illustrate a process for removing the plug 140 from the bottle 110. The notch 150 can be an enlarged portion of the annular slot 160. The notch 150 can provide an opening to insert a wedge between the annular cap protrusion 143 and the lower channel edge 119. Thus the notch 150 can provide an access point for a wedge to enter into the annular slot 160. The wedge can moved incrementally around the annular slot 160 to separate the annular cap protrusion 143 from the channel 115 without damage thereto. The wedge can engage with the lower channel edge 119 to separate the annular cap protrusion 143 from the channel 115, as it moves around the annular slot 160. In some implementations, the wedge can engage with an upper surface of the upper end 116*a* of one of the threads 116 to separate the annular cap protrusion 143 from the channel 115 as it moves around one or more portions of the annular slot 160. In bottles 110 where the notch 150 is adjacent to the upper end 116*a*, the upper end 116*a* can assist in initially separating the annular cap protrusion from the channel 115.

In one implementation, the wedge can be the bottom lip 122 of the outer cap 120. The bottom lip 122 can be pressed into the annular slot 160 through the notch 150. The bottom lip 122 can have a thickness approximately equal to or less than the height 150*a* of the notch 150. The bottle 110 and the plug 140 can then be rotated about a longitudinal axis 101. During rotation about the longitudinal axis 101, the bottom lip 122 can remain within the annular slot 160. The bottom lip 122 can be maintained within the annular slot 160 through continued application of a force on the outer cap 120. As the bottle 110 and the plug 140 are fully rotated around or before complete rotation, the plug 140 can be freed from the bottle 110. The annular cap protrusion 143 can be freed from the plug channel 115 and/or the plug portion 141 can be removed from within the mouth 111.

In one implementation of the method, the outer cap 120 can be held in the palm of a first hand and pressed into the annular slot 160 through the notch 150. With a second hand, the bottle 110 can be rotated about the longitudinal axis 101 with the palm of the first hand maintaining the force on the outer cap 120 within the annular slot 160.

Figure 8:
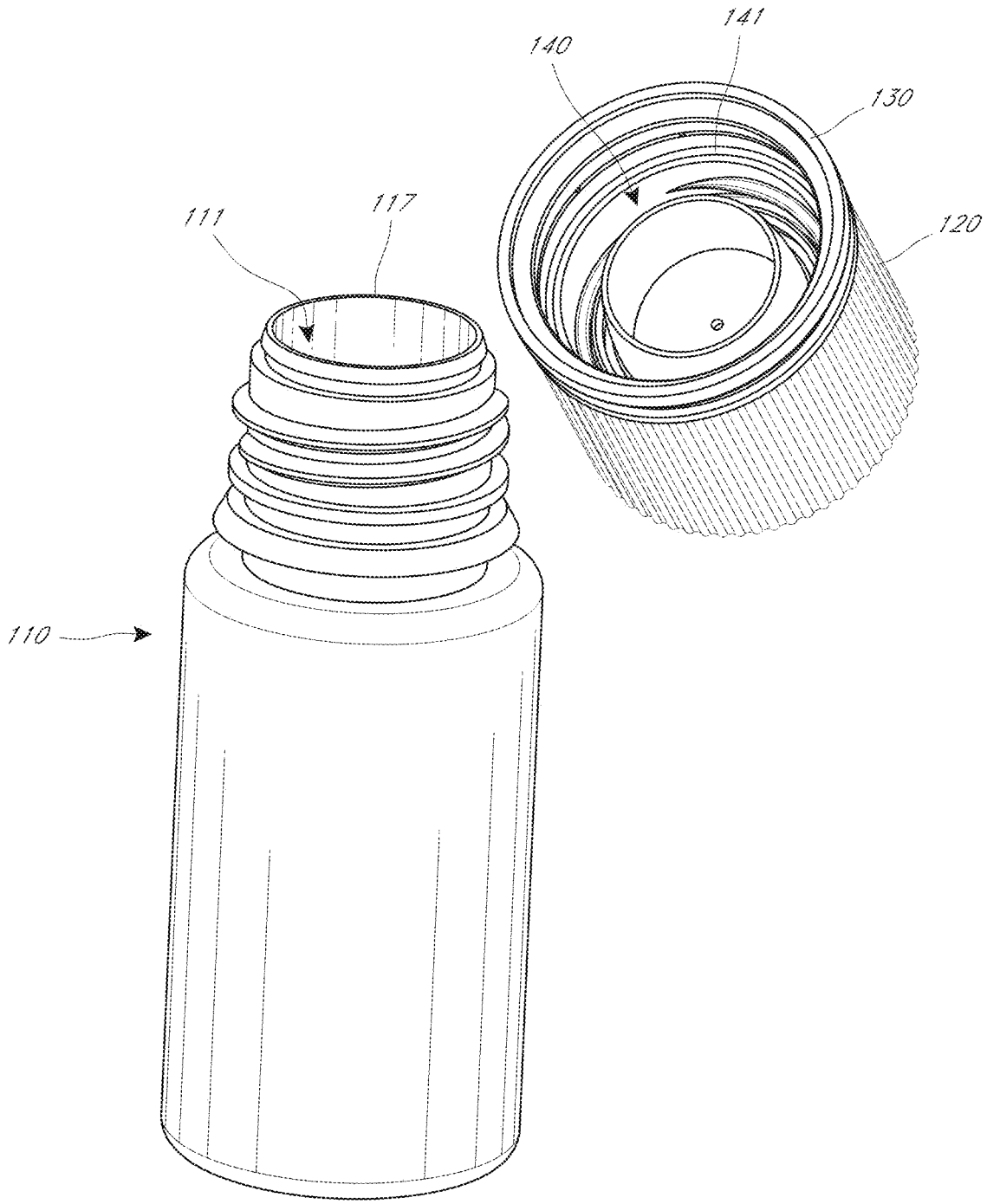
FIG. 8 shows a reassembly step for attaching the plug with the bottle of the bottle assembly of FIG. 1.

As shown in FIG. 8, in one implementation of the method, the plug 140 can be reattached with the bottle 110 through the use of the outer cap 120. The plug 140 can be placed within the inner cap 130. The nozzle 144 of the plug 140 can be inserted into the conical protrusion 132 of the inner cap 130. The conical protrusion 132 can center the plug 140 within the inner cap 130. The outer and inner caps 120, 130 with the plug 140 inside can then be placed over the finish 113 of the bottle 110. The plug 140 and the outer and inner caps 120, 130 can be pressed downward until the threaded region 134 engages with the threads 116. The outer and inner caps 120, 130 can be rotated to further engage the threaded region 134 with the threads 116 to seat the plug 140 fully onto the finish 116. The seating of the plug 140 onto the finish 140 can engage the annular cap protrusion 143 with the channel 115 and/or the plug portion 141 within the mouth 111.

Certain Terminology

Terms of orientation used herein, such as "top," "bottom," "proximal," "distal," "longitudinal," "lateral," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

SUMMARY

Several illustrative embodiments of bottles and related methods have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices, systems, and methods may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of bottles and related methods and related methods have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

What is claimed is:

1. A bottle assembly for containing and dispensing a liquid, comprising:

a bottle configured to contain a volume of the liquid, the bottle including a bottle body and a finish, the finish including a mouth of the bottle, a top surface extending around the mouth, and a plug channel around an outer circumference of the finish adjacent to the mouth;

a plug configured to seal the mouth of the bottle, the plug including:

a nozzle having a well extending therethrough;

a cap portion configured to contact the top surface of the bottle, the cap portion including an annular cap protrusion configured to sealingly engage within the plug channel of the finish;

wherein an annular slot is formed between the annular cap protrusion and a lower channel edge of the plug channel; and wherein the lower channel edge includes a notch, the notch comprising a chamfered region.

2. The assembly of claim 1, wherein the notch has a notch width from 2 mm to 10 mm.

3. The assembly of claim 1, wherein the notch has an angular width from 15° to 45°.

4. The assembly of claim 1, wherein a width of the chamfered region of the notch varies across a notch width.

5. The assembly of claim 1, further comprising:

an orifice in the cap portion of the plug, the orifice extending through the cap portion and aligned with the well;

wherein the orifice has a diameter from 0.5 mm to 1.5 mm.

6. The assembly of claim 1, wherein the well has a diameter of 1.2 mm+/−0.14 mm.

7. The assembly of claim 1, wherein the volume of the bottle is from 30 mL to 120 mL.

8. The assembly of claim 1, wherein an outer cap surface of the annular cap protrusion substantially aligns with an outer finish surface of the finish, except at the notch.

9. The assembly of claim 1, wherein the annular cap protrusion comprises an inner flange engaged within the plug channel, the notch providing access beneath the inner flange.

10. The assembly of claim 1, wherein the lower channel edge includes a plurality of notches spaced at regular intervals.

11. The assembly of claim 1, wherein the notch is a first notch and the lower channel edge includes a second notch, the second notch spaced 180° apart from the first notch.

12. The assembly of claim 1, wherein the notch is adjacent to an upper end of one of one or more threads.

13. The assembly of claim 1, further comprising an inner cap configured to assembly with the finish of the bottle, the inner cap including:

an inner threaded region for engagement with one or more threads of the finish;

an outer circumferential ring;

a top surface comprising one or more slots therein; and a conical protrusion configured to receive the nozzle of the plug.

14. The assembly of claim 13, further comprising an outer cap configured to rotatably couple with the inner cap, the outer cap including:

an inner circumferential ring configured to couple with the outer circumferential ring of the inner cap to couple the inner cap with the inner cap;

a grip portion;

a lower lip, the lower lip extending around a circumference of the outer cap;

a spring clip configured to engage with the conical protrusion of the inner cap; and one or more protrusions configured to engage with the slots of the inner cap to transfer a torque from the outer cap to the inner cap to remove the inner cap form the finish.

15. The assembly of claim 14, wherein the inner cap and the outer cap form a child safety lock, the spring clip and conical protrusion configured to bias the one or more protrusions of the outer cap away from the slots of the inner cap to prevent transfer of the torque from the outer cap to the inner cap without overcoming the bias of the spring clip.

16. A bottle assembly for containing and dispensing a liquid, comprising:

a bottle configured to contain a volume of the liquid, the bottle including a bottle body and a finish, the finish including a mouth of the bottle, a plug channel extending around a circumference of the finish adjacent the mouth;

an outer cap configured to assemble with the finish of the bottle; and a plug configured to seal the mouth of the bottle, the plug including:

a nozzle having an anti-drip well extending therethrough; and a cap portion configured to sealingly engage with the finish of the bottle, the cap portion including an annular cap protrusion configured to sealingly engage within the plug channel;

wherein the anti-drip well has a diameter of 1.2 mm and height of at least 12 mm; and wherein the cap portion of the plug includes an orifice aligned with the nozzle, the orifice extending through the cap portion and providing communication between the anti-drip well and the volume of liquid, the orifice having a diameter less than the diameter of the anti-drip well.

* * * * *